US008479428B1

(12) United States Patent
Desomma

(10) Patent No.: US 8,479,428 B1
(45) Date of Patent: Jul. 9, 2013

(54) FIREARM WITH FINISHED RECEIVER AND METHOD

(76) Inventor: Frank Desomma, Glendale, AZ (US)

( * ) Notice: Subject to any disclaimer, the term of this patent is extended or adjusted under 35 U.S.C. 154(b) by 1204 days.

(21) Appl. No.: 11/527,851

(22) Filed: Sep. 27, 2006

(51) Int. Cl.
*F41A 19/00* (2006.01)

(52) U.S. Cl.
USPC ..... 42/69.01; 42/76.02

(58) Field of Classification Search
USPC . 42/75.1, 75.01–75.03, 69.01–69.02; 89/179, 89/191.01–191.02, 1.25
See application file for complete search history.

(56) References Cited

U.S. PATENT DOCUMENTS 1,352,414 A * 9/1920 Payne ..... 42/106
5,386,659 A * 2/1995 Vaid et al. ..... 42/69.02
5,983,774 A * 11/1999 Mihaita ..... 89/187.02
6,308,448 B1 * 10/2001 Kapusta et al. ..... 42/69.02
6,347,474 B1 * 2/2002 Wolff, Jr. ..... 42/69.01
6,848,351 B1 * 2/2005 Davies ..... 89/191.01
7,051,467 B1 * 5/2006 Huber ..... 42/69.01
7,131,228 B2 * 11/2006 Hochstrate et al. ..... 42/75.01
2006/0265926 A1 * 11/2006 Sietsema ..... 42/76.02
2007/0033851 A1 * 2/2007 Hochstrate et al. ..... 42/75.01
2007/0079539 A1 * 4/2007 Karagias ..... 42/69.02

* cited by examiner

*Primary Examiner* — Michael David
(74) *Attorney, Agent, or Firm* — Parsons & Goltry; Robert A. Parsons; Michael W. Goltry

(57) ABSTRACT

A firearm including an upper receiver having inner bearing surfaces, a barrel having an end coupled to the upper receiver, a reciprocating bolt carrier carried by the receiver and movable between a locked position and an unlocked position, and a metal layer of lubricous material on the inner bearing surfaces. Surfaces of the upper receiver not covered by the metal layer are anodized.

11 Claims, 6 Drawing Sheets

10
12
14
15
18
19
20
22
23
25

FIREARM WITH FINISHED RECEIVER AND METHOD

FIELD OF THE INVENTION

This invention relates to firearms.

More particularly, the present invention relates to a finish for the receiver and operating system of a firearm.

BACKGROUND OF THE INVENTION

Several problems are prevalent in the art of firearm receivers and operating systems. Receivers tend to become fouled due to the firing of cartridges. Additionally, any dust, grit, and dirt entering the receiver can reduce operating efficiency and increase wear on parts. Lubricants used to ease the friction of the sliding of parts within the receiver tend to collect any particulate matter entering the receiver. At some point, the build up of this material can prevent proper operation of the firearm and will lead to accelerated wearing of parts. Cleaning is the only solution, Two main operating systems are employed and also have inherent problems. Those systems include gas operating systems and push rod operating systems. In a push rod operating system, a rod is reciprocated by gas generated through the firing of a cartridge. The rod mechanically engages a bolt carrier, pushing the bolt carrier backward after the firing of a cartridge. While this operating system works admirably, aligning the operating rod with the bolt carrier can be problematic. The gas operating system also functions satisfactorily and includes a gas tube which receives gas generated through the firing of the cartridge, and directs those gases to, and against the bolt carrier. The pressures generated by the gas force the bolt carrier in the rearward direction similar to the push rod. In this instance, while guiding a reciprocating rod is not required, the gases carried by the gas tube can leak into the bolt carrier fouling the firearm. Gases entering the bolt carrier in the upper receiver can deposit materials mixed with lubricating oil preventing the smooth operation of the firearm and eventually preventing any operation thereof.

It would be highly advantageous, therefore, to remedy the foregoing and other deficiencies inherent in the prior art.

SUMMARY OF THE INVENTION

Briefly, to achieve the desired objects of the present invention in accordance with a preferred embodiment thereof, provided is an upper receiver for a firearm. The firearm includes a bolt carrier carried for reciprocal movement therein. The upper receiver includes inner bearing surfaces with a metal layer of lubricous material deposited thereon. Surfaces of the upper receiver not covered by the metal layer are anodized.

In a further aspect of the present invention the upper receiver is for use in a firearm including a push rod operating system having a push rod. The upper receiver further includes a push rod guiding aperture extending into the upper receiver for receiving the push rod therethrough so as to engage the bolt carrier. The push rod guiding aperture is sized to stabilize and guide the push rod. In a specific aspect the inner bearing surfaces include the push rod guiding aperture.

Also provided is a method of finishing an upper receiver for a firearm including a bolt carrier carried for reciprocal movement therein. The method includes the steps of providing an upper receiver having inner bearing surfaces and depositing a metal layer of lubricous material thereon. Surfaces of the upper receiver not covered by the metal layer are anodized.

A further aspect of the method includes the firearm having a push rod operating system with a push rod. The method includes the step of forming a push rod guiding aperture extending into the upper receiver for receiving the push rod therethrough so as to engage the bolt carrier. The push rod guiding aperture is sized to stabilize and guide the push rod. Another aspect includes depositing the metal layer of lubricous material on an inner surface of the push rod guiding aperture.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figures 1, 2:
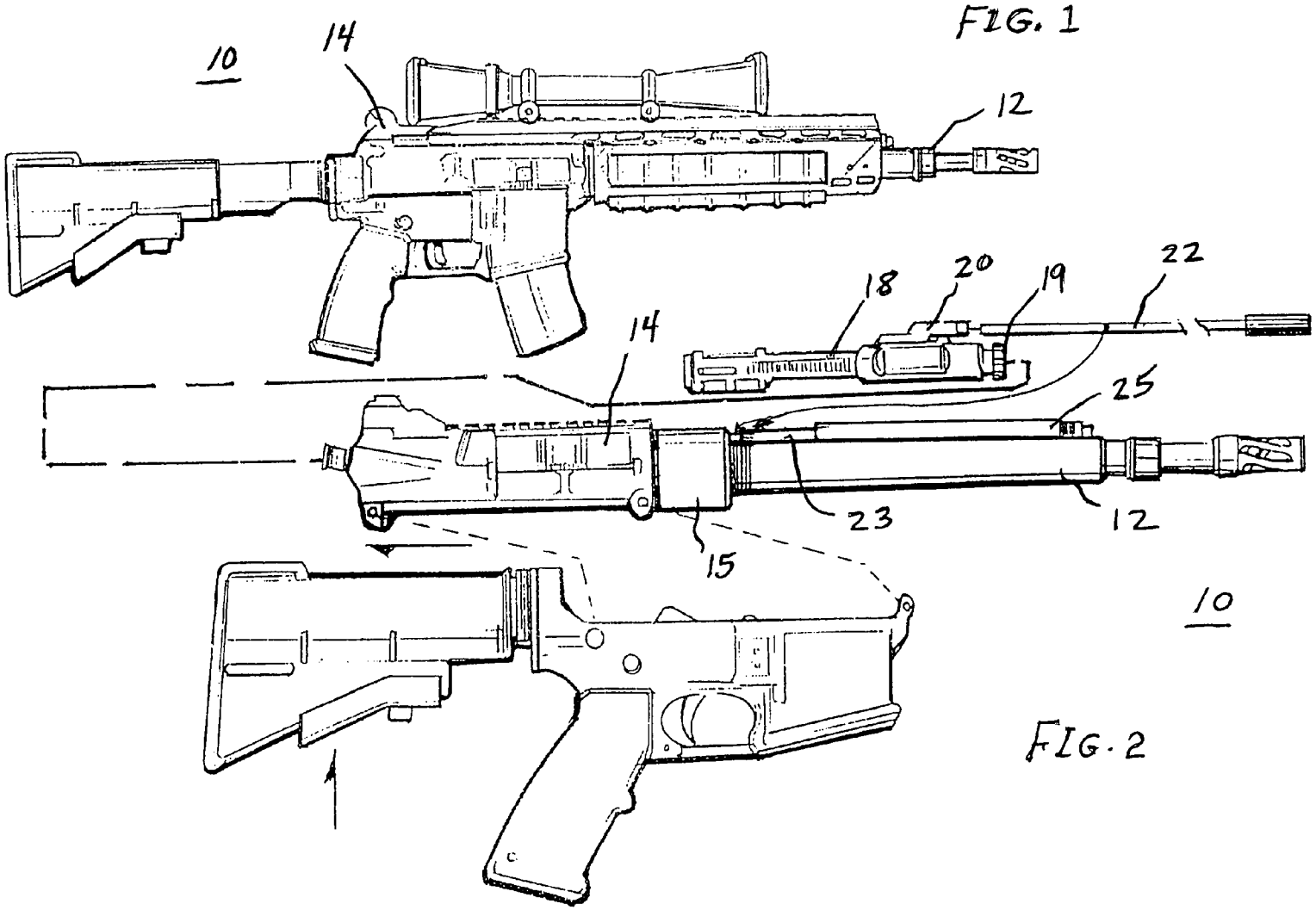
FIG. 1 is a side view of a firearm according to the present invention.
FIG. 2 is an exploded side view of the firearm of FIG. 1, with the handguard thereof removed.

Turning now to the drawings in which like reference characters indicate corresponding elements throughout the several views, attention is directed to FIGS. 1 and 2 which illustrate a firearm generally designated 10. Firearm 10 may be substantially any firearm utilizing a fully automatic or semiautomatic push rod operating system. Firearm 10 includes a barrel 12 coupled to an upper receiver 14 by a barrel nut 15. Upper receiver 14 carries a reciprocating bolt carrier 18 movable between a locked and an unlocked position. Bolt carrier 18 supports and positions a bolt 19. One skilled in the art will understand that the locked position is the position in which the bolt carrier positions the bolt for firing. The unlocked position is any position other than the locked position but specifically includes the position in which the bolt carrier retracts the bolt from the chamber to permit ejection of a casing and insertion of a cartridge. A mechanical key 20 is coupled to bolt carrier 18 and is engaged by a pushrod operating system for moving bolt carrier 18 between the locked and the unlocked positions.

Figure 4:
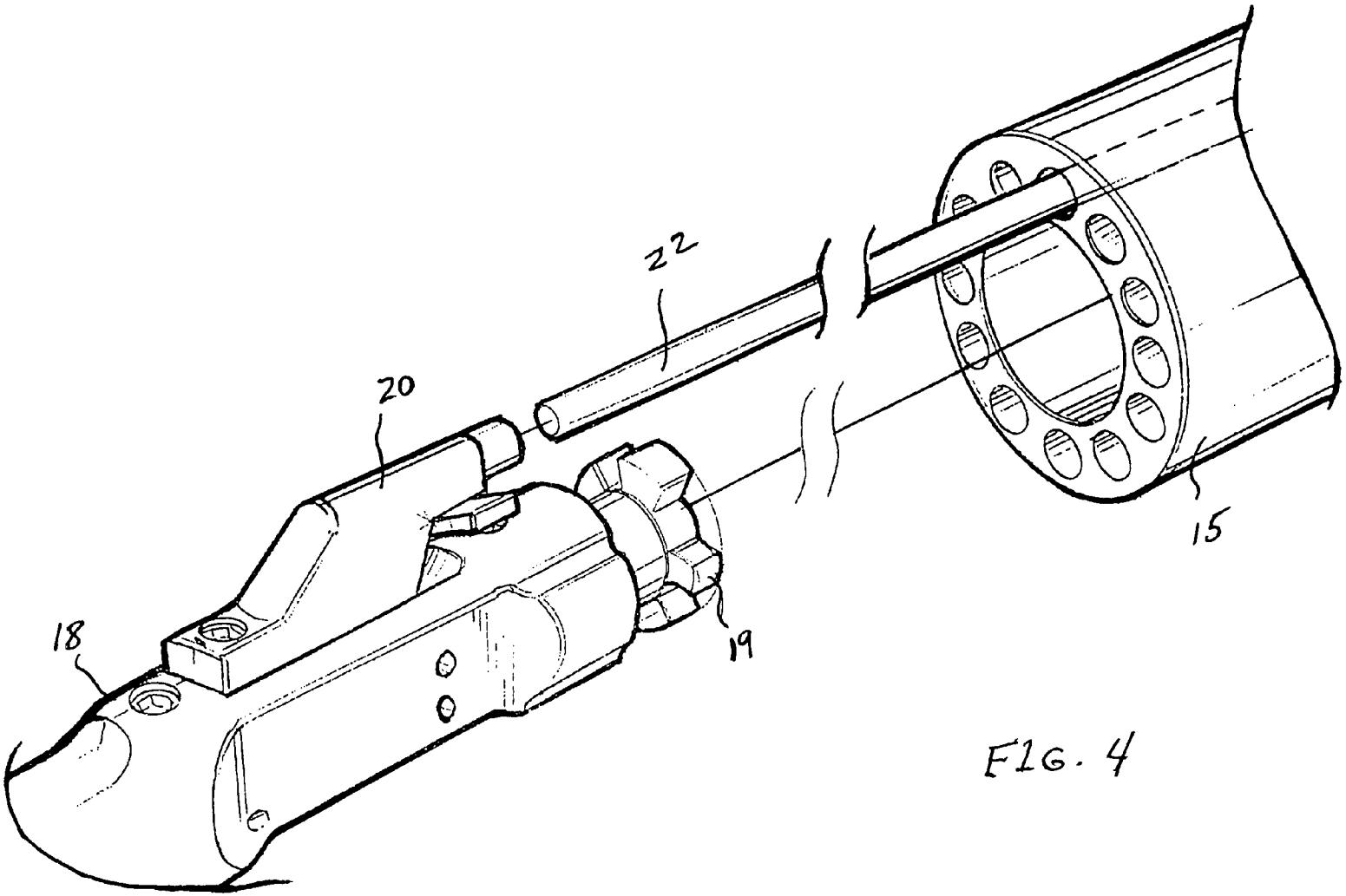
FIG. 4 is an enlarged perspective view of the push rod engaging the bolt carrier.
Figure 5:
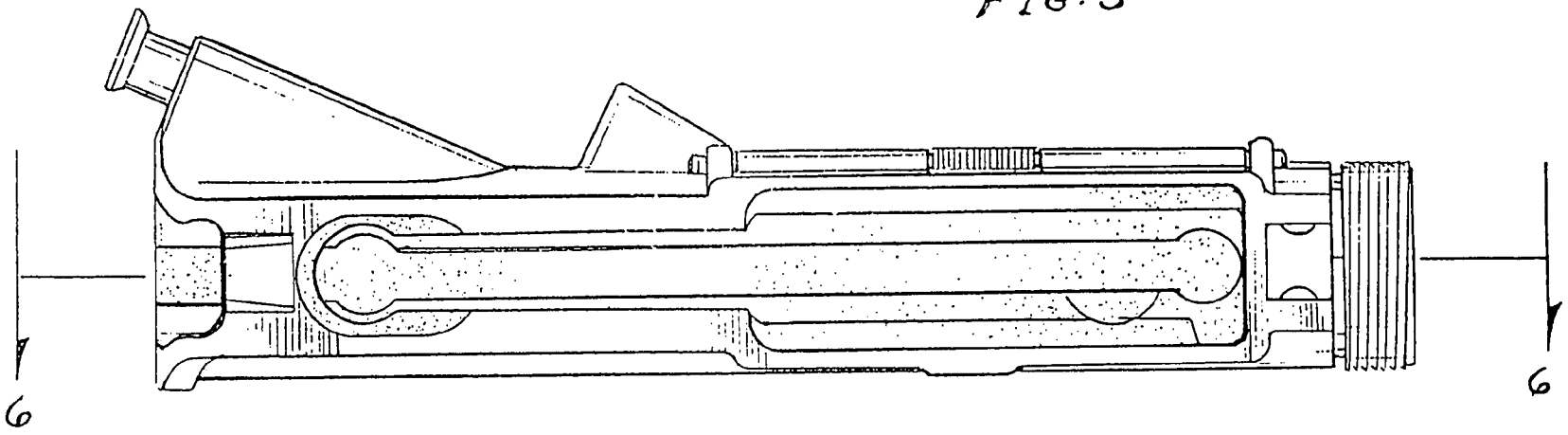
FIG. 5 is a bottom plan view of the upper receiver according to the present invention.
Figure 6:
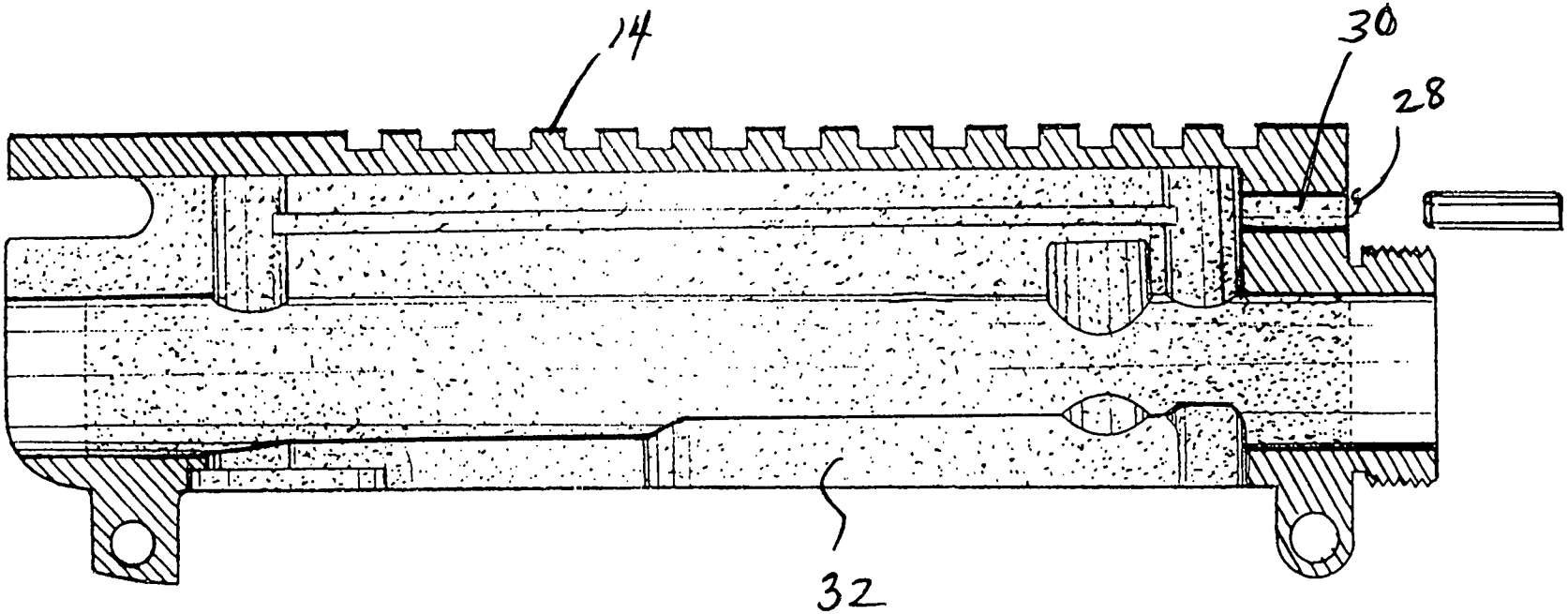
FIG. 6 is a sectional side view taken along line 6-6 of FIG. 5.

Still referring to FIGS. 1 and 2, the operating system of firearm 10 is a push rod system having a push rod 22 extending along a push rod tube 23 parallel to barrel 12 and terminating in an engagement with mechanical key 20. As firearm 10 is fired, gas from the detonated round enters the push rod tube and, through the use of a piston assembly 25, moves push rod 22 rearwardly. Rearward movement of push rod 22 pushes against key 20 moving bolt carrier 18 to the unlocked position. With additional reference to FIG. 4, bolt carrier 18 is illustrated. Bolt carrier 18 is of substantially conventional construction with mechanical key 20 affixed thereto. Push rod 22 extends through barrel nut 15 as illustrated, or over it in the case of a conventional barrel nut, and engages mechanical key 20.

Of major concern is alignment and stability of push rod 22 as it is reciprocated by the firing sequence. While barrel nut 15 can be employed to help stabilize and guide push rod 22, a specialized barrel nut needs close tolerances and a conventional barrel nut is ineffective. Additionally, the distance between the rear of the barrel nut and the mechanical key 20 can allow an appreciable deflection of push rod 22. Therefore, guidance and stabilization of push rod 22 between the barrel nut and the mechanical key is highly desirable.

Figure 3:
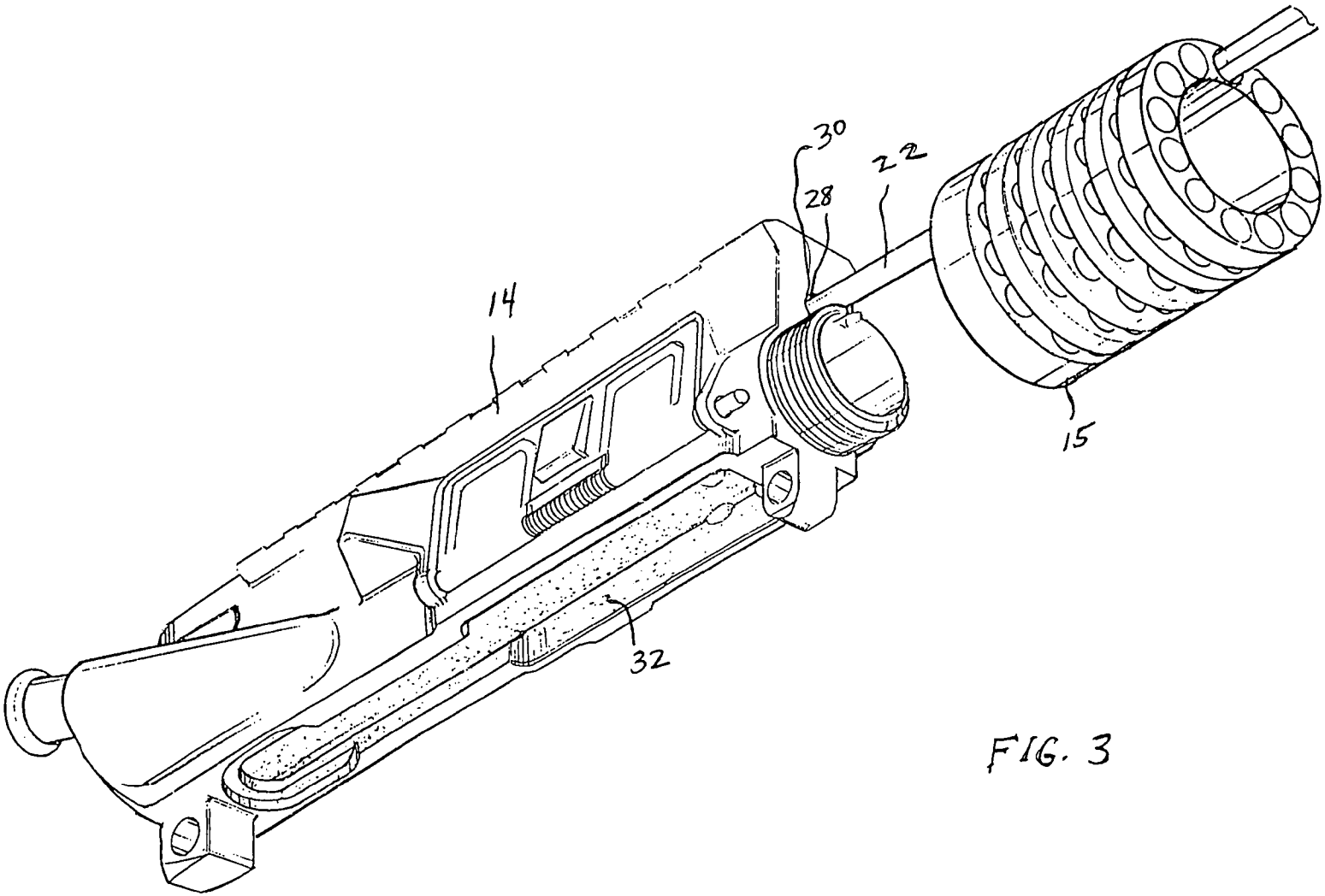
FIG. 3 is a perspective view of the upper receiver of the firearm according to the present invention.

Turning to FIG. 3, push rod 22 enters upper receiver 14 through a push rod guiding aperture 28 formed in the front thereof. The positioning of aperture 28 aligns push rod 22 with mechanical key 20, and securely holds it for reciprocating motion therethrough. A diameter of aperture 28 needs to be closely matched to the diameter of push rod 22 to prevent lateral deflection and maintain alignment with mechanical key 20. In this embodiment, reciprocating motion of push rod 22 and a close tolerance is facilitated by a lubricous layer 30 on the surface of aperture 28.

Upper receiver 14 contains moving parts such as bolt carrier 18, which conventionally requires lubrication (such as oil, graphite, etc.) to facilitate sliding engagements between surfaces. To reduce wear of parts, and to prevent adherence of fine particles such as dirt, sand and burned powder, a metal layer 32 of lubricous material is provided to replace fluid lubricants. Metal layer 32 is positioned on inner bearing surfaces of upper receiver 14, providing a lubricous surface over which moving parts, such as bolt carrier 18 and push rod 22, slide. The inner bearing surfaces of upper receiver 14 are those surfaces which engage moving parts, including bolt carrier 18 and push rod 22, and between which relative movement occurs. It should be understood that metal layer 32 can (and generally will) cover other surfaces in upper receiver 14 but is intended to cover at least the bearing surfaces. In this embodiment metal layer 32 includes lubricous layer 30. Thus, metal layer 32 is provided on inner surfaces of upper receiver 14 which interact with moving parts therein. Metal layer 32 is any low friction durable metal or metal alloy material which will provide anti-wear characteristics to the moving parts without requiring additional lubricants. Appropriate materials can include nickel, nickel alloys and the like, but is preferably silicon nickel or nickel silicon carbide.

Metal layer 32 on the surface of aperture 28 forms lubricous layer 30 providing a lubricous surface upon which push rod 22 reciprocates. Close tolerances can be employed for aperture 28 due to the low friction interaction between lubricous layer 30 and push rod 22. Additionally, the positioning of aperture 28 stabilizes push rod 22 close to mechanical key 20, providing stability and guidance at the optimum point.

Figure 7:
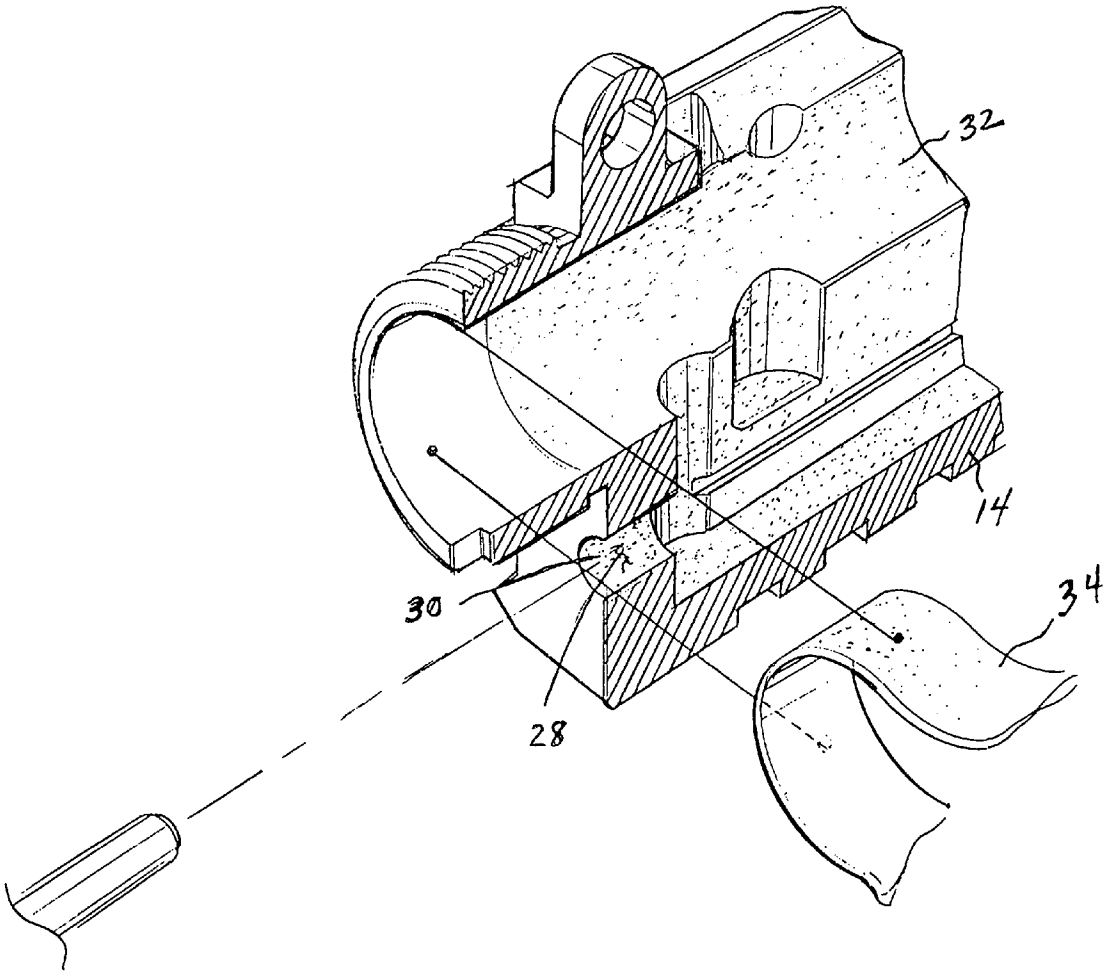
FIG. 7 is an enlarged partial sectional view of the upper receiver with push rod.

In this preferred embodiment, metal layer 32 is applied to upper receiver 14 by forming a coating on the entire upper receiver 14. Coating entire receiver 14 can be accomplished for example by placing upper receiver 14 in an electroplating bath. Once upper receiver 14 is coated, those areas of the coating comprising metal layer 32, including aperture 28, are masked using a mask 34, for example, a rubberized paint, urethane plug materials, and the like, represented by a small portion of mask 34 illustrated in FIG. 7. One skilled in the art will understand that the coating is simply a coating covering more of upper receiver 14 than is desired for metal layer 32. The unmasked portion of the coating is then removed leaving metal layer 32. A preferred method of removal is by etching using a nitrite to strip off the unmasked portion of the coating. Upper receiver 14 is then rinsed and cleaned to remove the etchant and prepare upper receiver 14 for anodizing. Mask 34 is removed and receiver 14 is anodized. Surfaces not having metal layer 32 are anodized providing a very hard durable surface for wear resistance. Metal layer 32 is not anodized due to the characteristics of the material employed. Once anodizing is complete, a distinct separation between anodized portions of receiver 14 and metal layer 32 is provided.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. An upper receiver for a firearm including a bolt carrier carried for reciprocal movement therein, the upper receiver comprising:

inner bearing surfaces;

a metal layer of lubricous material positioned on the inner bearing surfaces so as to form a lubricous outer surface of the inner bearing surfaces; and surfaces of the upper receiver not covered by the metal layer being anodized.

2. An upper receiver as claimed in claim 1 wherein the metal layer of lubricous material includes nickel.

3. An upper receiver as claimed in claim 2 wherein the lubricous material includes silicon nickel.

4. An upper receiver as claimed in claim 1 for use in a firearm including a push rod operating system having a push rod, the upper receiver further including a push rod guiding aperture extending into the upper receiver for receiving the push rod therethrough so as to engage the bolt carrier, the push rod guiding aperture being sized to stabilize and guide the push rod.

5. An upper receiver as claimed in claim 4 wherein the inner bearing surfaces include the push rod guiding aperture.

6. An upper receiver as claimed in claim 1 wherein all of the surfaces of the upper receiver not covered by the metal layer are anodized.

7. A firearm comprising:

an upper receiver having inner bearing surfaces;

a barrel having an end coupled to the upper receiver;

a reciprocating bolt carrier carried by the receiver and movable between a locked position and an unlocked position;

a metal layer of lubricous material positioned on the inner bearing surfaces so as to form a lubricous outer surface of the inner bearing surfaces whereby moving parts slide on the lubricous outer surface; and surfaces of the upper receiver not covered by the metal layer being anodized.

8. A firearm as claimed in claim 7 wherein the metal layer of lubricous material includes nickel.

9. A firearm as claimed in claim 8 wherein the lubricous material includes silicon nickel.

10. A firearm as claimed in claim 7 further including a push rod operating system having a push rod, the upper receiver further including a push rod guiding aperture extending into the upper receiver and receiving the push rod therethrough so as to engage the bolt carrier, the push rod guiding aperture being sized to stabilize and guide the push rod.

11. A firearm as claimed in claim 10 wherein the inner bearing surfaces include the push rod guiding aperture.

* * * * *